US008042715B2

(12) United States Patent
Charlier et al.

(10) Patent No.: US 8,042,715 B2
(45) Date of Patent: Oct. 25, 2011

(54) DISPENSING CLOSURE COMPRISING A SAFETY SYSTEM

(75) Inventors: Christophe Jean-Marie Yves Charlier, Parma (IT); Bruno Sadi Henri Delande, Marseille en Beauvaisis (FR); Jean-Francois Andre Aime Delaunay, La Chapelle Aux Pots (FR); Pierre Henri Lebrand, Bonlier (FR)

(73) Assignee: Nestec S.A., Vevey (CH)

( * ) Notice: Subject to any disclaimer, the term of this patent is extended or adjusted under 35 U.S.C. 154(b) by 737 days.

(21) Appl. No.: 12/278,953

(22) PCT Filed: Feb. 14, 2007

(86) PCT No.: PCT/EP2007/051419

§ 371 (c)(1),
(2), (4) Date: Aug. 8, 2008

(87) PCT Pub. No.: WO2007/093614

PCT Pub. Date: Aug. 23, 2007

(65) Prior Publication Data

US 2009/0026232 A1 Jan. 29, 2009

(30) Foreign Application Priority Data

Feb. 14, 2006 (EP) ..... 06101644

(51) Int. Cl.
*B67D 3/00* (2006.01)

(52) U.S. Cl. ..... 222/514; 222/54; 222/153.01; 222/153.14; 137/79; 236/93 A; 236/99 J

(58) Field of Classification Search ..... 222/153.01, 222/153.14, 513, 514, 54; 137/79; 236/93 A, 236/99 R, 99 F, 99 J See application file for complete search history.

(56) References Cited

U.S. PATENT DOCUMENTS 4,280,523 A * 7/1981 Norton ..... 137/74

(Continued)

FOREIGN PATENT DOCUMENTS

EP 1065150 B1 9/2004

(Continued)

OTHER PUBLICATIONS

International Search Report, Application No. PCT/EP2007/051419 and Written Opinion, Apr. 30, 2007.

*Primary Examiner* — Kevin P Shaver
*Assistant Examiner* — Donnell Long
(74) *Attorney, Agent, or Firm* — Winston & Strawn LLP

(57) ABSTRACT

A dispensing closure for a container that includes closure walls, at least one dispensing aperture, at least one closing element that is movable between a position where the aperture is closed, and a position where the aperture is open. This closure includes at least one actionable member that surrounds the closure walls and the closing element, a spring element disposed between the closing element and the closure walls to force the closing element to close the aperture, a connection device that includes a flexible pouch containing a temperature dependent material, and a catch mechanism. When the temperature is below a predetermined safety temperature the temperature dependent material is rigid enough so that the pouch restrains the catch mechanism in a position where the consumer can open the dispensing aperture by moving the actionable member, but when the temperature of the container is above the safety temperature, the temperature dependent material is sufficiently fluid so that the pouch is compressible to allow movement of the actionable member independently of the closing element, thus preventing a consumer from opening the dispensing aperture.

15 Claims, 5 Drawing Sheets

U.S. PATENT DOCUMENTS

| | | | | |
|---|---|---|---|---|
| 4,290,440 | A * | 9/1981 | Sturgis | 137/75 |
| 6,257,463 | B1 | 7/2001 | De Polo | 222/525 |
| 6,367,499 | B1 * | 4/2002 | Taku | 137/72 |
| 6,772,958 | B1 * | 8/2004 | Lamb et al. | 236/34.5 |
| 7,150,287 | B2 * | 12/2006 | Kita et al. | 137/72 |
| 7,407,113 | B2 * | 8/2008 | Guterman | 236/99 K |
| 7,789,276 | B2 * | 9/2010 | Delande et al. | 222/518 |
| 2002/0017538 | A1 | 2/2002 | Vakiener et al. | 222/525 |
| 2002/0190087 | A1 | 12/2002 | Vakiener et al. | 222/525 |

FOREIGN PATENT DOCUMENTS

| | | | |
|---|---|---|---|
| EP | 1591376 | B1 | 3/2008 |
| GB | 2187822 | A | 9/1987 |
| WO | WO 91/10607 | | 7/1991 |
| WO | WO03/086892 | A1 | 10/2003 |
| WO | WO2005/102869 | A1 | 11/2005 |

* cited by examiner

DISPENSING CLOSURE COMPRISING A SAFETY SYSTEM

This application is a 371 filing of International Patent Application PCT/EP2007/051419 filed Feb. 14, 2007.

The present invention relates to a dispensing closure for a container. It is particularly suitable for a pressurized container containing a frozen viscous product. It is known to use pressurized containers comprising dispensing valves. A dispensing valve allows a consumer to efficiently dose and dispense the product. An example of such a container with a dispensing closure is described in EP-A-1591376.

The product contained and dispensed can for example be soft ice cream. It has been found that soft ice cream and similar products have to be dispensed at a certain predetermined temperature from the container in which they are stored. For the soft ice cream to have a nice appearance to the consumer when it is dispensed, it is known that the dispenser has to be at a temperature less than about −15° C. More importantly, for soft ice cream that is stored in a pressurized container, if the container is too warm and therefore if the ice cream is too fluid, there is a risk that ice cream squirts out of the container opening with force. However, it should be understood that this example is not limitative, and that other types of temperature sensitive products can also suitably be dispensed using the dispensing closure of the invention.

The dispensing closure of the invention has a safety system that prevents dispensing of the contained product when the temperature of the container is above a predetermined safety temperature. For example, when the product is a frozen viscous product, the safety system ensures that a consumer cannot actuate the dispensing valve system when the product is too fluid.

The invention concerns a dispensing closure for a container comprising:

closure walls, at least one dispensing aperture, at least one closing element that is movable relative to the closure walls between a first position where said dispensing aperture is closed, and a second position where the dispensing aperture is open and the product is dispensed, at least one actionable means that surrounds said closure walls and said closing element, and a spring element disposed between said closing element and said closure walls, so as to naturally force the closing element in a position where it closes said aperture, said dispensing closure being characterized in that it further comprises at least one connection device comprising a flexible pouch containing a temperature dependent material, and a catch mechanism adjacent the pouch which can move between a position where it operatively connects the closing element and the actionable means and a position where the catch mechanism allows the actionable means to move independently of the closing element, so that when the temperature of the container is below a predetermined safety temperature the temperature dependent material is rigid enough that the pouch restrains the catch mechanism in the position where it operatively connects the closing element and the actionable means, thus allowing a consumer to open the dispensing aperture by moving said actionable means, and when the temperature of the container is above said safety temperature the temperature dependent material is sufficiently fluid that the pouch is compressible by the catch mechanism so that the catch mechanism moves to the position where it allows the actionable means to move independently of the closing element, thus preventing a consumer from opening the dispensing aperture by moving said actionable means.

The invention includes a pressurized container for a frozen viscous product, characterized in that the container is closed by a dispensing closure as defined above.

The invention also concerns a process for incorporating a temperature dependent material in a dispensing closure of the type comprising:

closure walls, at least one dispensing aperture, at least one closing element that is movable relative to the closure walls between a first position where said dispensing aperture is closed and a second position where the dispensing aperture is open and the product is dispensed, said closure further comprising at least one actionable means that surrounds said closure walls and said closing element and a spring element disposed between said closing element and said closure walls, so as to naturally force the closing element in a position where it closes said aperture, said dispensing closure further comprising at least one connection element that is disposed between said actionable means and said closing element, said element comprising a temperature dependent material that is rigid enough, when the temperature of the container is below a predetermined safety temperature, to connect said actionable means and said closing element, thus allowing a consumer to open the dispensing aperture by moving said actionable means, and liquid when the temperature of the container is above said safety temperature, so that said actionable means and said closing element are disconnected, said process being characterized in that the temperature dependent material is incorporated in a pouch which cooperates with a catch mechanism so that when the temperature of the container is below a predetermined safety temperature the temperature dependent material is rigid enough that the pouch restrains the catch mechanism in the position where it operatively connects the closing element and the actionable means, thus allowing a consumer to open the dispensing aperture by moving said actionable means, and when the temperature of the container is above said safety temperature the temperature dependent material is sufficiently fluid that the pouch is compressible by the catch mechanism so that the catch mechanism moves to the position where it allows the actionable means to move independently of the closing element, thus preventing a consumer from opening the dispensing aperture by moving said actionable means.

In a highly preferred embodiment of the invention, the safety temperature is comprised between −35° C. and +50° C., even more preferably comprised between −25° C. and −10° C.

In a preferred embodiment of the present invention, the actionable means comprises an outer ring that surrounds said closing element.

In a first embodiment of the invention, the closure walls can define a vertical cylindrical channel which is in fluid contact with the interior of the container body, and which comprises at least one lateral dispensing aperture in its upper part. The closing element can have the shape of a ring that seals around the channel, and is movable relative to said channel along an axis which is parallel to the longitudinal axis of the channel when the outer ring and the closing element are connected and the outer ring is moved downwards (towards the container). Preferably a spring element is located between the closing ring and the closure walls so as to force said closing ring in a position where it closes the dispensing aperture.

The pouch can for example be arranged in a cavity in the closing element, said cavity being adjacent to the interface with the actionable means. In one embodiment the pouch is positioned behind a flexible lamella which is adapted to press against the pouch when the actionable means is moved. The pouch can for example be toroidal with the cavity being a circumferential groove in the closing element. Alternatively one or more discrete flexible pouches can be used, each in its own cavity.

Alternatively the pouch can be arranged in a cavity in the actionable means, the cavity being adjacent to the interface with the closing element. The cavity can for example be a circumferential groove in the actionable means used with a toroidal pouch, or one or more discrete flexible pouches can be used, each in its own cavity. The pouch can be positioned behind a flexible lamella which is adapted to press against the pouch when the actionable means is moved.

In a second embodiment of the invention, the closure walls can define a vertical cylindrical channel which is in fluid contact with the interior of the container body, and comprises at least one lateral dispensing aperture in its upper part, said closing element having the shape of a ring that seals around the said channel, and is movable relative to said channel by rotation around an axis which is parallel to the longitudinal axis of the channel when the outer ring and the closing element are connected and the outer ring is rotated. In this embodiment, the cavity in which the pouch is arranged is preferably a vertical groove either in the closing element or in the actionable means, adjacent their interface with each other. The pouch can be positioned behind a flexible lamella, as described above, which is adapted to press against the pouch when the actionable means is moved.

The invention will now be described in greater detail, with reference to the attached set of drawings, which represent one embodiment of a container according to the present invention. The following example is given by way of illustration only and in no way should be construed as limiting the scope and subject matter of the invention as described and claimed.

In the following description, and for the sake of clarity, the container of the invention as well as all of its components, are considered in the vertical position, so that the closed side of the container body is in contact with a flat horizontal support, and the side of the container body to which the closure is attached is oriented upwards.

Figure 1:
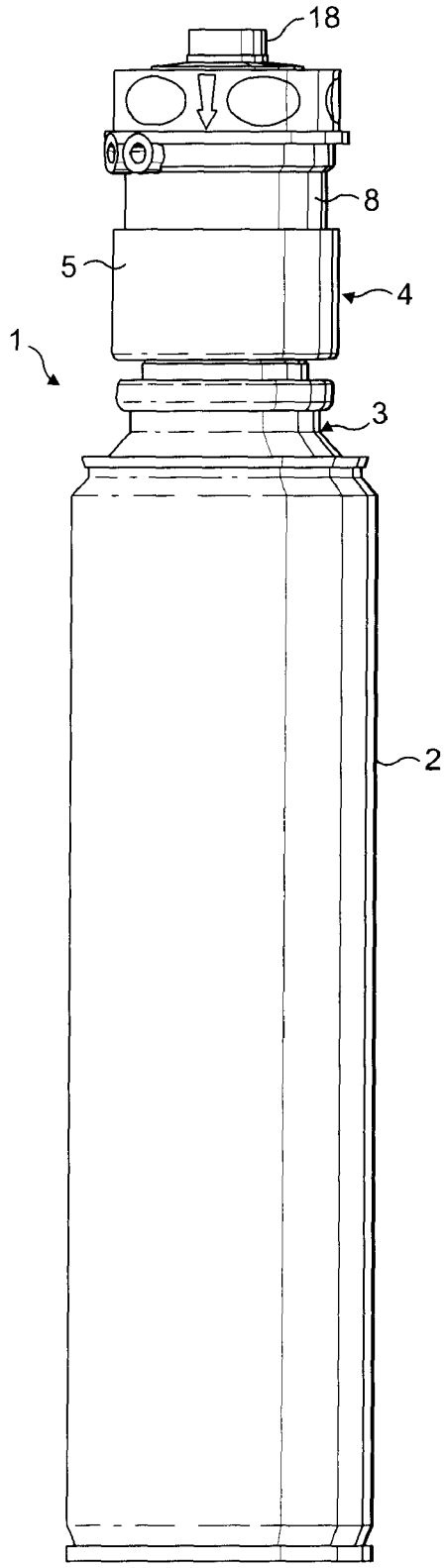
FIG. 1 is a profile view of a container closed with a dispensing closure according to the present invention.

FIG. 1 represents one embodiment of a container according to the present invention. The container 1 represented in FIG. 1 is a pressurized container for storing and dispensing a frozen viscous product, for example soft ice cream.

Figure 2:
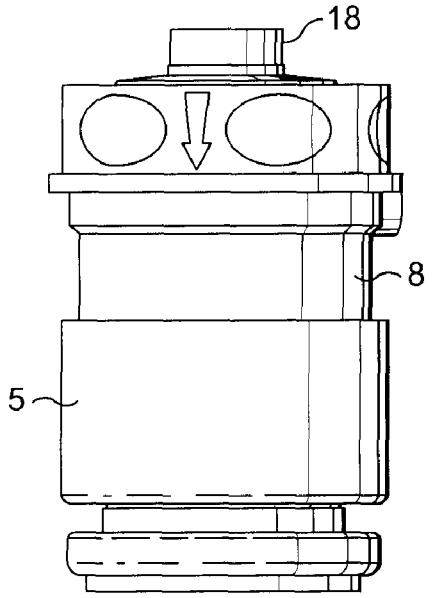
FIG. 2 is a profile view of a closure according to the invention.

The container 1 comprises a container body 2 for containing the product having an opening 3, and a dispensing closure 4 sealingly attached to the container body opening 3 which is represented in an enlarged view in FIG. 2.

Figure 3:
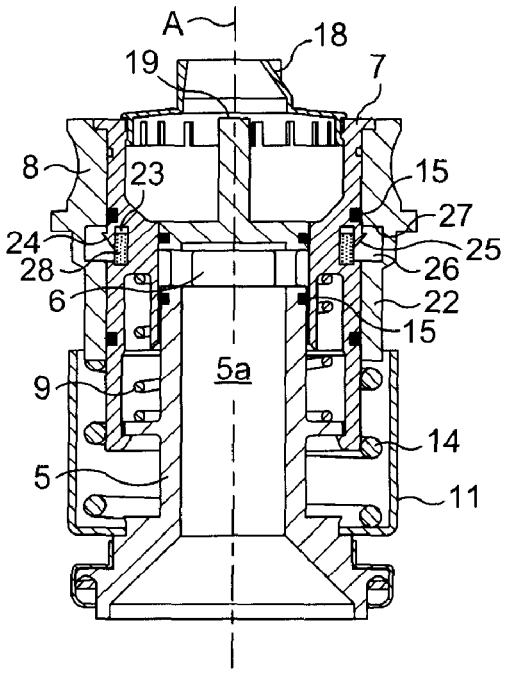
FIG. 3 is a profile cut view of a closure according to the invention, in the closed configuration.
Figure 4:
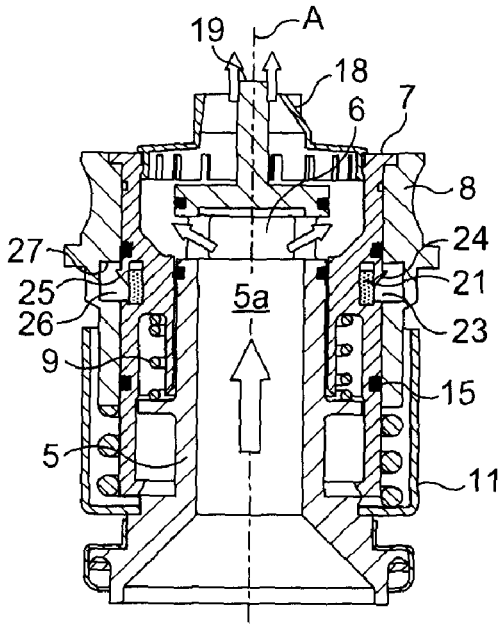
FIG. 4 is a profile cut view of the closure of FIG. 3 in the open configuration.

Referring also to FIG. 3, the dispensing closure 4 comprises closure walls 5, at least one dispensing aperture 6, at least one closing element 7 that is movable relative to the closure walls between a first position where said dispensing aperture 6 is closed (FIG. 3), and a second position where the dispensing aperture is open and the product is dispensed (FIG. 4).

The closure 4 further comprises at least one actionable means 8 that surrounds said closure walls 5 and said closing element 7. In the embodiment shown in the drawings, the actionable means 8 comprises an outer ring that surrounds and is movable relative to said closing element 7.

As seen in FIG. 3, a spring element 9 is disposed between said closing element 7 and said closure walls 5, so as to naturally force the closing element in a position where it closes said aperture 6.

In the embodiment of the invention that is represented in FIGS. 2 to 7, the closure walls 5 define a vertical cylindrical channel which is in fluid contact with the interior of the container body 2. The channel 5*a* comprises a lateral dispensing aperture 6 in its upper part, and a shoulder portion 11 in its lower part. The closing element 7 has the shape of a ring that seals around the channel 5*a* and is movable relative to said channel by translation along an axis A which is parallel to the longitudinal axis of the channel.

According to the present invention, the dispensing closure 4 further comprises at least one connection device comprising a flexible pouch 21 containing a temperature dependent material, and a catch mechanism 22 adjacent the pouch which can move between a position where it operatively connects the closing element 7 and the actionable means 8 and a position where the catch mechanism 22 allows the actionable means 8 to move independently of the closing element 7.

Figure 6:
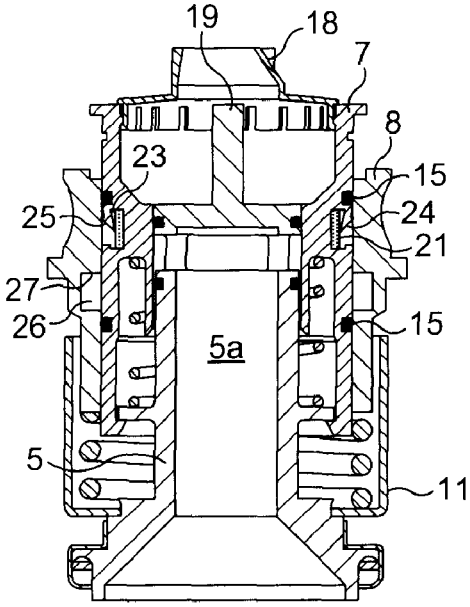
FIG. 6 is a profile cut view of the closure of FIGS. 3 and 4 in the safety configuration.

The temperature dependent material is such that when the temperature of the container is below a predetermined safety temperature the temperature dependent material is rigid enough that the pouch 21 restrains the catch mechanism 22 in the position where it operatively connects the closing element 7 and the actionable means 8. This allows a consumer to open the dispensing aperture by moving said actionable means 8. When the temperature of the container is above said safety temperature the temperature dependent material is sufficiently fluid that the pouch 21 is compressible by the catch mechanism 22 so that the catch mechanism moves to the position where it allows the actionable means 8 to move independently of the closing element 7 (FIG. 6). This prevents a consumer from opening the dispensing aperture 6 by moving said actionable means 8.

In the embodiment of the invention shown in FIGS. 3 to 7, the pouch 21 is positioned in a cavity 23 which is a groove extending circumferentially around the closing element 7 at its interface with actionable means 8. The catch mechanism 22 comprises a flexible lamella 24 extending downwards from the top of cavity 23.

The temperature dependent material in pouch 21 can comprise any eutectic material suitable for meeting the melting conditions stated above. It can be a pure liquid, or a mixture. It can be for example water, an aqueous solution, a propylene glycol based mix, an alcohol based mix, or even the same product as is contained inside the container body. In the embodiment of the invention that is currently described, and having regard to the fact that the product contained inside the container is soft ice cream, the safety temperature is around −15° C.

The wall of the pouch 21 can be made of any liquid tight flexible material, for example a flexible plastics material. The wall of the pouch 21 should generally be softer (more deformable) than the lamella 24.

Figure 5:
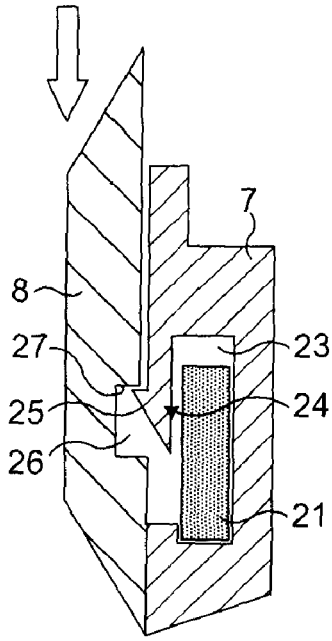
FIG. 5 is a larger scale profile cut view of the pouch and associated catch mechanism of the closure of FIGS. 3 and 4 as the actionable means are operated when the container is at the correct temperature.
Figure 7:
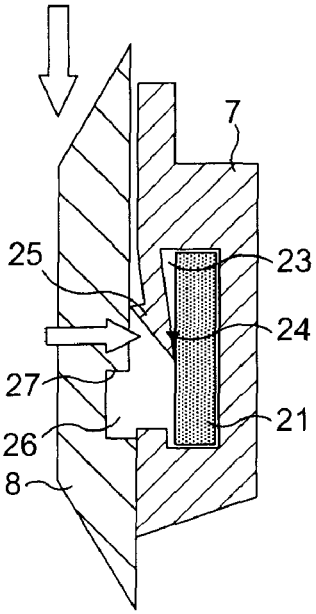
FIG. 7 is a larger scale profile cut view of the pouch and associated catch mechanism of the closure of FIGS. 3, 4 and 6 as the actionable means are operated when the container is at a temperature above the safety temperature.

The lamella 24 is formed with a protrusion 25 capable of acting as a detent. The outer ring 8 forming the actionable means has a cavity 26. In the embodiment shown, the cavity 26 is a circumferential groove in outer ring 8. The top of the cavity 26 forms a lip 27 with which the detent 25 can engage to operatively connect the closing element 7 and the outer ring 8 so that they move together when the fluid in pouch 21 is rigid. The shape of the detent 25 relative to the lip 27 should be such that downwards movement of the outer ring 8 relative to closing element 7, as shown in FIGS. 5 and 7, tends to push the lamella 24 towards the pouch 21. The lamella 24 is flexible enough that such movement, if unrestrained by the pouch 21, deforms the lamella to disengage detent 25 from lip 27.

Figure 8:
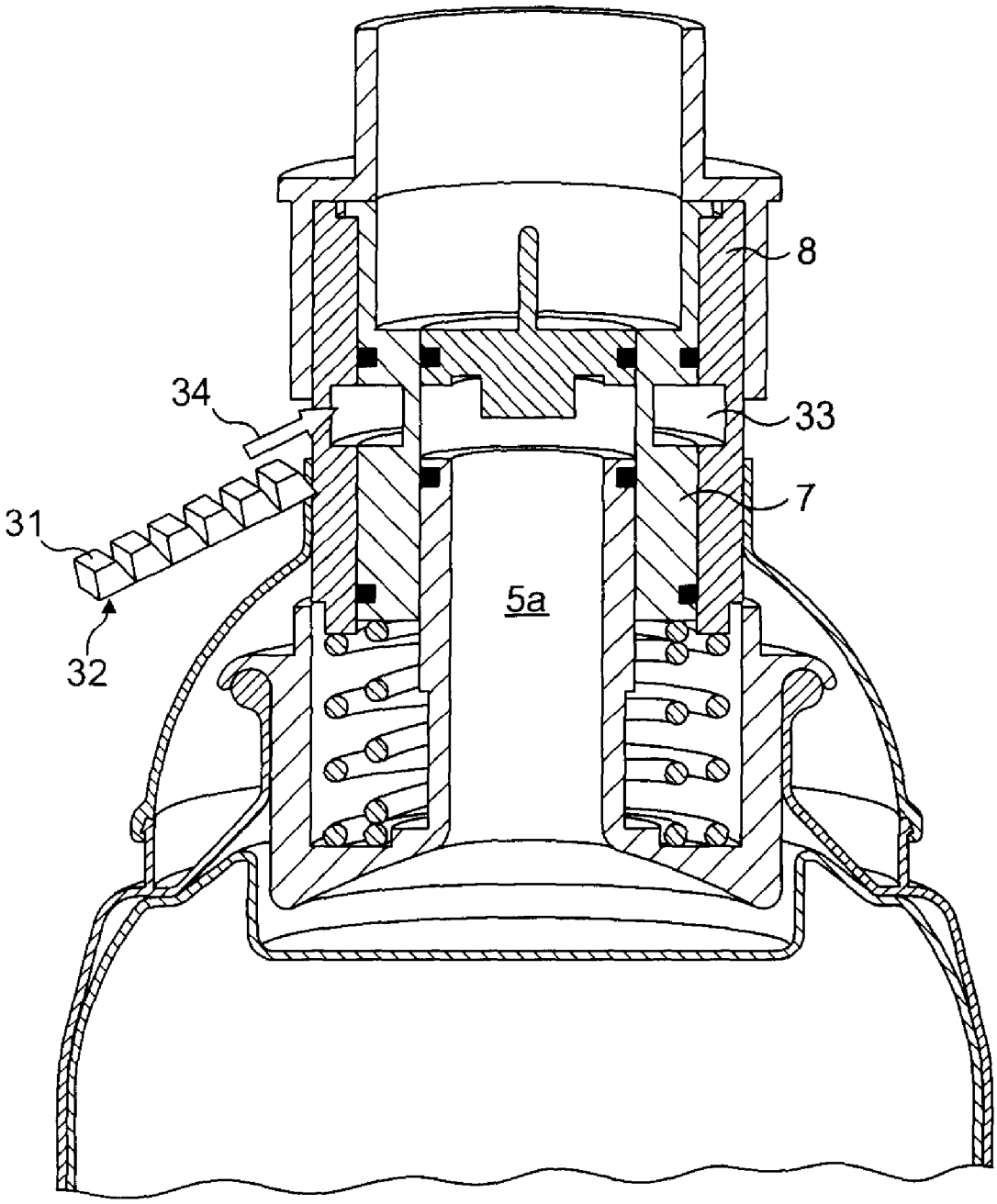
FIG. 8 is profile cut view of an alternative closure shown during assembly.

The cavity 23 containing pouch 21 and the small cavity 26 in the outer ring 8 are disposed such that they face each other when the closing element 7 closes the dispensing aperture 6, as represented in FIG. 3, with the detent 25 positioned against the lip 27 as represented in FIG. 5. In the embodiment shown, the cavity 23 containing pouch 21 is in closure element 7 and the small cavity 26 is in the outer ring 8. It will be appreciated that the cavity 23 containing pouch 21 could alternatively be in outer ring 8 with the small cavity 26 having lip 27 being in closing element 7. The cavities 23 and 26 are shown as continuous grooves, but could alternatively be one or more pairs of cavities each having a pouch and a catch mechanism. The pouch 21 in such a continuous groove can be a single toroidal pouch or can be a series of pouches as can be formed for example by welding lines across a filled continuous pouch (FIG. 8).

A spring element 14 is located between the closing ring 7 and the closure walls 5 so as to force said ring in a position where the cavity 23 containing pouch 21 and the small cavity 26 in the outer ring 8 face each other with the detent 25 positioned against the lip 27. More precisely, this spring element 14 presses on the closure walls in the region of the shoulder 11.

At rest, the closing ring 7 is in the upward position and closes the lateral opening 6 of the dispensing channel 5, as represented in FIG. 3. Simultaneously, the outer ring 8 is also in the upward position as represented in FIG. 3.

When the consumer wishes to dispense some ice cream, he/she pulls the outer ring 8 downwards, as is represented in FIG. 5. If the container temperature is below the predetermined safety temperature (for example less than −17° C. in the present example), pulling the outer ring leads the closing ring 7 downward as well, since both closing and outer rings are connected to each other by engagement of the catch mechanism 22. The catch mechanism 22 is held in place by the pouch 21 which is rigid because the temperature dependent material is rigid. The closing element 7 is moved to the position shown in FIG. 4. Ice cream can flow upwards, out of the channel 5 through the lateral dispensing aperture, as shown by arrows in the FIG. 5. A nozzle 18 can be added to give a particular shape to the dispensed product.

When the container temperature is too high, the temperature dependent material in the pouch 21 will become fluid. In this case, when the consumer pulls the outer ring 8 downwards, as is represented in FIG. 7, the lamella 24 is pushed against the pouch 21 and bends towards the pouch, because the pouch is not rigid enough to hold the lamella in position. The detent 25 is thus disengaged from the lip 27 of cavity 26 and the catch mechanism no longer connects the closing ring 7 and the outer ring 8. In that case, as shown in FIGS. 6 and 7, pulling downward the outer ring 8, will not lead the closing ring 7 downwards as well, and the channel dispensing aperture 6 will stay closed.

In that configuration of the preferred embodiment, the outer upper surface of the closing ring 7 becomes visible to the consumer, as shown in FIG. 6, and this visible portion can advantageously be printed with a message (not represented in the drawings), informing the consumer that the container temperature is too high for dispensing the contents.

If the container temperature is too low, the ice cream may be too viscous to flow. In this case, at the time the consumer pulls the outer ring downwards, the ice cream does not flow. Preferably, it is arranged that at this time the consumer can see a "too cold" indicator 19 which protrudes out of the nozzle 18, and which is marked for example with the wording "too cold". The "too cold" indicator may have the shape of a pin 19 attached to the closure walls and located inside the nozzle, and having a length such that it is normally within the nozzle, but protrudes out of said nozzle when the actionable means 8 and the closing element 7 are pulled downwards by the consumer. At correct dispensing temperature, the ice cream flows out of the container nozzle 18 as shown in FIG. 4, thereby hiding the "too cold" indicator.

A set of instructions may be given to the consumer on the container, explaining what is the best dispensing temperature range. If the container temperature is too low, the consumer can warm it, for example by letting it out of the freezer at room temperature until the container temperature is higher enough.

In all cases, when the consumer releases the outer ring 8, said ring is forced upward by the spring element 14 located between said outer ring and the closure walls, as it is illustrated in FIG. 3.

European Patent Applications no. 05100386 and 05100397 describe the use of temperature dependent material in a safety system for a dispensing closure. In that application the temperature dependent material is disposed between the actionable means 8 and the closing element 7. Incorporation of the temperature dependent material in a pouch according to the present invention has the advantage of greatly reduced risk of spillage of the temperature dependent material in its fluid state, and thus less requirement for liquid tight joints between the outer ring 8 and the closing element 7. The dispensing closure may however have two horizontal annular joints 15 that are disposed between the closing element 7 and the outer ring 8. The joints 15 are distant from each other so that the cavity 23 containing pouch 21 is between the joints 15, as shown in FIGS. 5 and 6.

Similar tightness joints may be disposed between the channel 6 and the inner ring 7.

The pouch 21 is preferably inserted into the cavity 23 when the temperature dependent material is in its fluid state. The pouch can most simply be inserted into the cavity 23 in closing element 7 before closing element 7 is assembled with outer ring 8. In an alternative embodiment (not shown) the closing element 7 can be formed of a lower part nearer the container in use and an upper part including nozzle 18 further from the container in use, and the lower part can be assembled with the actionable means 8 to form an assembly having an opening at the top. The pouch 21 can then be filled into cavity 23 through the opening. The upper part of the closing element 7 is subsequently assembled with the said assembly thereby sealing the opening.

In an alternative embodiment shown in FIG. 8 the pouch is a series of pouches 31 joined as a strip 32. The strip 32 thus has an undulating section along its length. The strip 32 of pouches can be used with a cavity which is a continuous groove 33 or may fit a series of cavities around the perimeter of the closing element 7. The strip 32 is introduced between the outer ring 8 and the closing element 7 of the dispensing valve through an aperture 34 made in the outer ring 8. The length of the strip 32 corresponds to the perimeter of the closing element 7. Rotation of the closing element 7 urges the strip 32 around the closing element so that the strip is wound around the closing element and becomes positioned in the continuous groove 33 or series of cavities around the perimeter of the closing element. The depressions between the bumps 31 of the strip 32 give the strip some flexibility so that it can be guided around the closing element 7. The aperture 34 can, if desired, subsequently be filled by a plug (not shown).

The invention claimed is:

1. A dispensing closure for a container that includes closure walls, at least one dispensing aperture, at least one closing element that is movable relative to the closure walls between a first position where said dispensing aperture is closed, and a second position where the dispensing aperture is open and the product is dispensed, at least one actionable means that surrounds the closure walls and closing element, and a spring element disposed between the closing element and closure walls so as to naturally force the closing element in a position where it closes the aperture, with the dispensing closure including at least one connection device comprising:

a flexible pouch containing a temperature dependent material, and a catch mechanism adjacent the pouch which can move between a position where it operatively connects the closing element and the actionable means and a position where the catch mechanism allows the actionable means to move independently of the closing element, so that when the temperature of the container is below a predetermined safety temperature the temperature dependent material is rigid enough that the pouch restrains the catch mechanism in the position where it operatively connects the closing element and the actionable means, thus allowing a consumer to open the dispensing aperture by moving the actionable means, and when the temperature of the container is above the safety temperature the temperature dependent material is sufficiently fluid that the pouch is compressible by the catch mechanism so that the catch mechanism moves to the position where it allows the actionable means to move independently of the closing element, thus preventing a consumer from opening the dispensing aperture by moving the actionable means.

2. The dispensing closure of claim 1, wherein the pouch is arranged in a cavity in the closing element, with the cavity being adjacent an interface with the actionable means behind a flexible lamella adapted to press against the pouch when the actionable means is moved.

3. The dispensing closure of claim 2, wherein the flexible lamella has a detent on the face of the lamella away from the pouch, which detent engages with a lip on the actionable means to operatively connect the closing element and the actionable means.

4. The dispensing closure of claim 1, wherein the pouch is arranged in a cavity in the actionable means, with the cavity being adjacent an interface with the closing element behind a flexible lamella adapted to press against the pouch when the actionable means is moved.

5. The dispensing closure of claim 4, wherein the flexible lamella has a detent on the face of the lamella away from the pouch, which detent engages with a lip on the closing element to operatively connect the closing element and the actionable means.

6. The dispensing closure of claim 1, wherein the pouch has a toroidal shape and the cavity is a circumferential groove in the closing element.

7. The dispensing closure of claim 1, wherein the pouch has a toroidal shape, the actionable means is an actionable member and the cavity is a circumferential groove in the actionable member.

8. The dispensing closure of claim 1, wherein the at least one pouch comprises a series of pouches joined as a strip having an undulating section along its length.

9. The dispensing closure of claim 8, wherein the cavity is a circumferential groove in the closing element.

10. The dispensing closure of claim 8, wherein the strip of pouches fits a series of cavities around the perimeter of the closing element.

11. A process for incorporating temperature dependent material into a dispensing closure that includes:

closure walls, at least one dispensing aperture, at least one closing element that is movable relative to the closure walls between a first position where the dispensing aperture is closed and a second position where the dispensing aperture is open and the product is dispensed, at least one actionable means that surrounds the closure walls and closing element and that includes a spring element disposed between the closing element and closure walls, so as to naturally force the closing element in a position where it closes the aperture, and at least one connection element disposed between the actionable means and closing element and comprising a temperature dependent material that is rigid enough, when the temperature is below a predetermined safety temperature, to connect the actionable means and closing element, thus allowing a consumer to open the dispensing aperture by moving the actionable means, and but is liquid when the temperature is above the safety temperature, so the actionable means and closing element are disconnected, with the process comprising:

incorporating the temperature dependent material in a pouch which cooperates with a catch mechanism so that when the temperature of the container is below the predetermined safety temperature, the temperature dependent material is sufficiently rigid such that the pouch restrains the catch mechanism in the position where it operatively connects the closing element and the actionable means, thus allowing a consumer to open the dispensing aperture by moving the actionable means, and when the temperature of the container is above the safety temperature, the temperature dependent material is sufficiently fluid such that the pouch is compressible by the catch mechanism so that the catch mechanism moves to the position where it allows the actionable means to move independently of the closing element, thus preventing a consumer from opening the dispensing aperture by moving the actionable means.

12. The process of claim 11, wherein the pouch is introduced into the dispensing closure while the temperature dependent material is in a fluid state.

13. The process of claim 11, wherein the pouch has a toroidal shape and is fitted around the closing element in a circumferential groove.

14. The process of claim 11, wherein the pouch comprises a series of pouches joined as a strip and the strip is introduced into the closure through an aperture in the actionable means and is wound around the closing element so that the strip is in a continuous groove or series of cavities around the perimeter of the closing element.

15. A pressurized container for a frozen viscous product that includes a dispensing closure according to claim 1.

* * * * *